United States Patent [19]

Hasenclever

[11] 4,405,511

[45] Sep. 20, 1983

[54] CLEANING INTENSIFIER FOR USE IN DRY-CLEANING MACHINES EQUIPPED WITH ADSORPTION FILTERS

[75] Inventor: Kaspar D. Hasenclever, Taunusstein, Fed. Rep. of Germany

[73] Assignee: Chemische Fabrik Kreussler & Co. GmbH, Wiesbaden, Fed. Rep. of Germany

[21] Appl. No.: 360,636

[22] Filed: Mar. 22, 1982

[30] Foreign Application Priority Data

Mar. 21, 1981 [DE] Fed. Rep. of Germany ..... 3111129

[51] Int. Cl.[3] ..... C11D 1/40; C11D 1/44; C11D 3/43; D06L 1/04

[52] U.S. Cl. ..... 252/547; 8/142; 252/8.8; 252/153; 252/171; 252/174.21; 252/544; 252/546; 252/548

[58] Field of Search ..... 8/142; 252/106, 153, 252/171, 544, 546, 547, 548

[56] References Cited

U.S. PATENT DOCUMENTS

| | | | |
|---|---|---|---|
| 1,836,047 | 12/1931 | Somerville | 252/544 |
| 3,057,676 | 10/1962 | Wedell | 252/544 |
| 3,095,373 | 6/1963 | Blomfield | 252/8.8 |
| 3,628,911 | 12/1971 | Grunewalder | 8/142 |
| 3,859,225 | 1/1975 | McKnight | 252/153 |
| 4,021,377 | 5/1977 | Borchert | 252/546 |
| 4,124,517 | 11/1978 | Hisamoto | 252/544 |
| 4,135,879 | 1/1979 | Hasenclever | 8/142 |
| 4,292,035 | 9/1981 | Battrell | 8/137 |
| 4,338,204 | 7/1982 | Spadini | 252/8.75 |

FOREIGN PATENT DOCUMENTS 2905207 8/1979 Fed. Rep. of Germany ..... 252/153

*Primary Examiner*—Dennis L. Albrecht
*Attorney, Agent, or Firm*—Michael J. Striker

[57] ABSTRACT

A cleaning intensifier is disclosed for use in dry-cleaning machines equipped with adsorption filters, which intensifier is not adsorbed by the filters. The cleaning intensifier contains a quaternary ammonium salt in the form of difatty alkyl dimethyl ammonium chloride containing from 12 to 18 carbon atoms in the alkyl radical or a mixture of the homologues, and the triammonium salt of a tricarboxylic acid citric acid or tricarballylic acid, and a tertiary amine in the form of a fatty alkyl dimethylamine containing from 8 to 18 carbon atoms in the alkyl radical or a hydroxy ethyl amine derivative corresponding to the formula $$HO-C_2H_4-O-\underset{\underset{R}{|}}{CH}-CH_2-N(C_2H_4-OH)_2$$

where R is a fatty alkyl radical containing from 10 to 18 carbon atoms, or a mixture of these triammonium salts. Preferred embodiments include content of nonyl phenyl ethoxylate containing from 5 to 11 moles of ethylene oxide or a fatty alcohol ethoxylate containing from 10 to 18 carbon atoms in the alcohol component and 3 to 9 moles of ethylene oxide or a mixture of these ethoxylates as the non-ionic surfactant; and content of a $C_2$–$C_8$-alkylene glycol as the alcohol.

4 Claims, No Drawings

CLEANING INTENSIFIER FOR USE IN DRY-CLEANING MACHINES EQUIPPED WITH ADSORPTION FILTERS

This invention relates to a cleaning intensifier for use in dry-cleaning machines equipped with adsorption filters. It is distinguished by the new property that it is not adsorbed by the adsorption filters, nor does it adversely affect their adsorption capacity for fatty acids.

Dry cleaning baths become dirty in the cleaning of textiles and have to be regenerated at regular intervals which, hitherto, has been done solely by distillation. In the continuing search for possible ways of saving energy, it is becoming increasingly common for dry cleaning baths to be freed from the dirt and dyes dissolved out of the textiles by means of adsorption filters rather than by distillation. To this end, the dry cleaning liquid is passed through adsorption filters of the type described, for example, in U.S. Pat. No. 240,413 or in OE-PS No. 329,496. The disadvantage of this method lies in the fact that, although the filters remove fatty acids and dyes from the dirty dry cleaning liquid, they also deprive the dry cleaning liquid of the necessary cleaning intensifiers added to it for improving the cleaning effect of its solvents and for antistatic effects. This not only weakens the cleaning effect of the dry cleaning liquid and increases the discolouration of the textiles to be cleaned, it also limits the adsorption capacity of the filters for fatty acids. However, the removal of fatty acids is essential for satisfactory dry cleaning because otherwise the textiles would take on an unpleasant odour (for further information, see the Final Report dated 31.12.1978 of the Bekleidungsphysiologisches Institut e.V. Bonigheim zum AIF Forschumgsvorhaben Nr. 3646).

It has now been found that the disadvantage of the adsorbability of cleaning intensifiers to the adsorption filters, which hitherto has been regarded as basically unavoidable, can be eliminated by using an active-substance combination consisting of from 5 to 30% by weight of difatty alkyl dimethyl ammonium chloride containing from 12 to 18 carbon atoms in the fatty alkyl radical, from 5 to 30% by weight of the triammonium salt of one of the tricarboxylic acids, citric acid or tricarballylic acid (1,2,3-propane tricarboxylic acid) and a tertiary amine, namely fatty alkyl dimethyl amine or a tertiary hydroxy ethylamine derivative corresponding to the formula

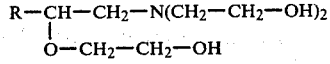

where R is a $C_{10}$–$C_{18}$-fatty alkyl radical, from 15 to 50% by weight of nonyl phenyl ethoxylate containing from 5 to 11 moles of ethylene oxide or a fatty alcohol ethoxylate of $C_{10}$–$C_{18}$-fatty alcohols and 3 to 9 moles of ethylene oxide or a mixture thereof, from 5 to 15% by weight of an alkyl glycol containing from 2 to 8 carbon atoms and from 5 to 20% by weight of water, as the cleaning intensifier according to the invention instead of the active-substance mixtures of conventional cleaning intensifiers (of which two examples are given in the following explanatory Example 1).

These cleaning intensifier-surfactant combinations according to the invention are not adsorbed to any significant extent by the adsorption filters and do not adversely affect the adsorption capacity of the filters for fatty acids and dyes. In addition, by comparison with dry cleaning baths containing conventional cleaning intensifiers, they enhance the cleaning effect of the bath, reduce the discolouration of the textiles and ensure that the cleaned textiles do not build up any electrostatic charges.

The advantages of the cleaning intensifiers according to the invention used in dry cleaning machines equipped with adsorption filters are illustrated by the following Examples.

EXAMPLE 1

A study was made of the adsorption of oleic acid—as a model fatty acid—in dependence upon the presence of different cleaning intensifiers, the adsorption of the cleaning intensifiers themselves being determined at the same time.

To this end, either the oleic acid itself or the oleic acid and the cleaning intensifiers was/were dissolved in the same volume of tetrachloroethene as a typical solvent in dry cleaning baths and the resulting solution circulated for three hours through an adsorption filter which, for all the tests, had been filled with the same quantity of fresh adsorption mixture of active carbon and activated alumina according to U.S. Pat. No. 240,413. Thereafter the residual content of the substances used still present in the baths after adsorption was determined by residue determination, two-phase titration by Epton's method and by determination of the fatty acid value in accordance with DIN 53981, Section 8.8.

Two conventional cleaning intensifiers A, B and a cleaning intensifier C according to the invention were used.

Cleaning intensifier A was a conventional anionactive cleaning intensifier having the following composition:

30% by weight of potassium dodecyl benzene sulfonate,

15% by weight of nonyl phenyl ethoxylate containing 3 moles of ethylene oxide,

10% by weight of coconut oil fatty alcohol ethoxylate containing 7 moles of ethylene oxide, 5% by weight of cyclohexanol, 15% by weight of water and 25% by weight of white oil.

The cleaning intensifier B was a conventional nonionic cleaning intensifier having the following composition:

55% by weight of nonyl phenyl ethoxylate containing 3 moles of ethylene oxide,

25% by weight of coconut oil fatty alcohol ethoxylate containing 9 moles of ethylene oxide and 20% by weight of oleic acid amide ethoxylate containing 10 moles of ethylene oxide.

The cleaning intensifier C according to the invention had the following composition:

15% by weight of ditallow alkyl dimethyl ammonium chloride,

15% by weight of tri-soya alkyl dimethyl ammonium citrate,

15% by weight of nonyl phenyl ethoxylate containing 9 moles of ethylene oxide,

20% by weight of coconut oil fatty alcohol ethoxylate containing 5 moles of ethylene oxide, 15% by weight of hexylene glycol and 20% by weight of water.

The initial and residual oleic acid and cleaning intensifier contents in the solvent, tetrachloroethene, before and after adsorption are shown in the following Table.

| Test | Substance | Initial content g/l | | Residual content g/l | |
|---|---|---|---|---|---|
| a | oleic acid | 10 | | 1.3 | |
| b | oleic acid | 5 | | 3.8 | |
| | cleaning intensifier A | | 5 | | 2.6 |
| c | oleic acid | 5 | | 3.4 | |
| | cleaning intensifier B | | 5 | | 3.2 |
| d | oleic acid | 5 | | 0.4 | |
| | cleaning intensifier C | | 5 | | 4.7 |

The results clearly show that, where conventional cleaning intensifiers (cases b and c) are used, they suppress the adsorption of oleic acid to a considerable extent by comparison with the absence of a cleaning intensifier (case a) insofar as they themselves are adsorbed to a considerable degree, whereas where a cleaning intensifier according to the invention (case d) is used, the adsorption of oleic acid is unaffected and the cleaning intensifier remains almost completely in the cleaning bath.

EXAMPLE 2

500 kg of textiles were cleaned in a standard dry cleaning machine fitted with an adsorption filter following the addition of 0.25% by weight (based on the weight of the textiles) of cleaning intensifier A of Example 1.

After the filter had been replaced and the cleaning bath renewed, another 500 kg of textiles were cleaned under comparable conditions, but on this occasion after the addition of 0.25% by weight (based on the weight of the textiles) of a cleaning intensifier D according to the invention consisting of 15% by weight of coconut oil dialkyl dimethyl ammonium chloride, 15% by weight of the triammonium salt of tricarballylic acid and the following hydroxy ethyl amine derivative as tertiary amine:

$$R-\underset{\underset{O-C_2H_4-OH}{|}}{CH}-CH_2-N(C_2H_4-OH)_2$$

where R is a linear $C_{12}$ or $C_{14}$-alkyl radical,

10% by weight of nonly phenyl ethoxylate containing 5 moles of ethylene oxide,

25% by weight of coconut oil fatty alcohol ethoxylate containing 7 moles of ethylene oxide, 15% by weight of hexylene glycol and 20% by weight of water.

The cleaned textiles were assessed for the cleaning effect of the dry cleaning bath, for fluff formation, for electrostatic charging and for the odour of the cleaned textiles.

The results obtained in qualitative terms with cleaning intensifiers A and D are set out in the following Table:

| Cleaning Intensifier | A | D |
|---|---|---|
| Cleanness of the textile: | satisfactory | good |
| Fluff formation of the textile: | heavy | hardly any |
| Electrostatic charging of the textile: | very heavy | none |
| Odour of the textile: | oily | neutral |

Whereas, where the conventional cleaning intensifier A was used, customer complaints were received on the grounds of unpleasant odour and fluff formation on the cleaned textiles, the quality of cleaning obtained where cleaning intensifier D according to the invention was used was entirely acceptable to the customer.

The outstanding property of the cleaning intensifiers according to the invention of not being adsorbed on adsorption filters of dry cleaning machines is attributable in particular to the presence in the cleaning intensifiers of the quaternary ammonium chloride but primarily to the content of the triammonium salt of the tricarboxylic acids and tertiary amines according to the invention. Although the triammonium salts of citric acid and carballylic acid were only used individually in the Examples, it is obvious that mixtures of the triammonium salts may also be used with equal advantage in accordance with the invention.

I claim:

1. A cleaning intensifier for use in drycleaning machines equipped adsorption filters comprising in addition to a non-ionic surfactant, an alcohol and water, a quaternary ammonium salt in the form of difatty alkyl dimethyl ammonium chloride containing from 12 to 18 carbon atoms in the alkyl radical or a mixture of the homologues, and the triammonium salt of a tricarboxylic acid and a tertiary amine in the form of a fatty alkyl dimethylamine containing from 8 to 18 carbon atoms in the alkyl radical or a hydroxy ethyl amine derivative corresponding to the formula $$HO-C_2H_4-O-\underset{\underset{R}{|}}{CH}-CH_2-N(C_2H_4-OH)_2$$

where R is a fatty alkyl radical containing from 10 to 18 carbon atoms, or a mixture of these triammonium salts wherein said recited components are present in amounts and proportions effective so as not to be adsorbed to any significant extent by the adsorption filters, to reduce discoloration of textiles and to ensure that cleaned textiles do not build up any substantial electrostatic charge.

2. A cleaning intensifier as claimed in claim 1, characterised in that it contains nonyl phenyl ethoxylate containing from 5 to 11 moles of ethylene oxide or a fatty alcohol ethoxylate containing from 10 to 18 carbon atoms in the alcohol component and 3 to 9 moles of ethylene oxide or a mixture of these ethoxylates as the non-ionic surfactant.

3. A cleaning intensifier as claimed in claim 1, characterised in that it contains a $C_2$–$C_8$-alkylene glycol, preferably hexylene glycol, as the alcohol.

4. A cleaning intensifier as claimed in claims 1, 2 or 3, characterised by the following composition:

from 5 to 30% by weight of difatty alkyl dimethyl ammonium chloride, from 5 to 30% by weight of triammonium citrate and/or the triammonium salt of carballylic acid, from 15 to 50% by weight of nonyl phenyl ethoxylate(s) and/or fatty alcohol ethoxylate(s), from 5 to 15% by weight of alkylene glycol and from 5 to 20% by weight of water.

* * * * *